US006789376B1

(12) United States Patent
Greenwood et al.

(10) Patent No.: US 6,789,376 B1
(45) Date of Patent: Sep. 14, 2004

(54) METHOD AND MACHINE FOR THE MANUFACTURE OF AIR PILLOWS

(75) Inventors: John Stuart Greenwood, Hoxne (GB); Neil Glynn Price, St. Denis (FR)

(73) Assignee: Pactiv Corporation, Lake Forest, IL (US)

( * ) Notice: Subject to any disclaimer, the term of this patent is extended or adjusted under 35 U.S.C. 154(b) by 0 days.

(21) Appl. No.: 10/088,095

(22) PCT Filed: Sep. 22, 1999

(86) PCT No.: PCT/GB99/03174

§ 371 (c)(1),
(2), (4) Date: Jun. 6, 2002

(87) PCT Pub. No.: WO01/21391

PCT Pub. Date: Mar. 29, 2001

(51) Int. Cl.[7] ..... B67B 7/00
(52) U.S. Cl. ..... 53/468; 53/79
(58) Field of Search ..... 53/450, 451, 550, 53/551, 459, 403, 568, 79

(56) References Cited

U.S. PATENT DOCUMENTS

| | | | | |
|---|---|---|---|---|
| 2,877,609 A | 3/1959 | Bodolay et al. | ..... | 53/28 |
| 3,389,534 A | 6/1968 | Pendleton | ..... | 53/180 |
| 3,492,783 A | 2/1970 | Dohmeier | ..... | 53/186 |

(List continued on next page.)

FOREIGN PATENT DOCUMENTS

| | | | | |
|---|---|---|---|---|
| DE | 19913408 A1 | 10/2000 | ..... | B65D/81/107 |
| EP | 0155109 A2 | 9/1985 | ..... | B65D/81/06 |
| EP | 0256346 A2 | 2/1988 | ..... | B42F/5/04 |
| EP | 0315882 A1 | 5/1989 | ..... | B65B/9/13 |

(List continued on next page.)

OTHER PUBLICATIONS

Brochure: Packaging Systems, Pactiv Advanced Packaging Solutions; Pactiv Corporation 1996, 6 color pages.

Patent Abstracts of Japan, vol. 1995, No. 4 (May 31, 1995), Publication No. 07016961.

Patent Abstracts of Japan, vol. 1995, No. 9, (Oct. 31, 1995), Publication No. 07165267.

*Primary Examiner*—Eugene Kim
*Assistant Examiner*—John Paradiso
(74) *Attorney, Agent, or Firm*—Winston & Strawn LLP

(57) ABSTRACT

A machine for the manufacture of air-filled pillows includes a mounting (14. 114) on which a roll (16) of thin-walled plastic tube is mounted, and a drive system (50. 150) to draw the flat-wound tube from the supply and to feed the tube intermittently through the machine. The machine includes an injection means (70, 74: 170, 174) operative intermittently to inject air into the space between upper and lower walls (16*a*, 16*b*) of the tube, and a sealing system (60, 160) downstream of the injection means, and which is operative intermittently to seal the upper and lower walls of the tube together, particularly around the aperture through which air has been injected, and to provide a tear-line between the adjacent pillows. The machine includes a separator member (20, 120) which may be located manually within the tube upstream of the injection means, a system (30, 130) being provided to maintain the separator member in an operative position within the machine during advancement of the tube through the machine. The separator member (20, 120) is operative to retain the upper and lower walls (16*a*, 16*b*) of the tube apart, and in particular includes a rear housing (24, 124*a*), provided with an injection aperture through which an injection nozzle (76, 176) of the injection system may be inserted, having previously passed through one of the walls of the tube, to inject a quantity of air into the space between the upper and lower walls.

9 Claims, 10 Drawing Sheets

U.S. PATENT DOCUMENTS

| | | | | | |
|---|---|---|---|---|---|
| 3,559,874 | A | | 2/1971 | Titchenal | 229/69 |
| 3,575,757 | A | | 4/1971 | Smith | 156/147 |
| 3,596,428 | A | | 8/1971 | Young et al. | 53/28 |
| 3,660,189 | A | | 5/1972 | Troy | 156/145 |
| 3,667,593 | A | | 6/1972 | Pendleton | 206/46 FR |
| 3,791,573 | A | | 2/1974 | Titchenal et al. | 229/69 |
| 3,817,803 | A | | 6/1974 | Horsky | 156/85 |
| 3,938,298 | A | | 2/1976 | Luhman et al. | 53/7 |
| 4,017,351 | A | | 4/1977 | Larson et al. | 156/494 |
| 4,021,283 | A | | 5/1977 | Weikert | 156/244 |
| 4,049,854 | A | | 9/1977 | Casey et al. | 428/72 |
| 4,076,872 | A | | 2/1978 | Lewicki et al. | 428/12 |
| 4,096,306 | A | | 6/1978 | Larson | 428/192 |
| 4,169,002 | A | | 9/1979 | Larson | 156/145 |
| 4,169,344 | A | | 10/1979 | Ganz et al. | 53/546 |
| 4,412,879 | A | | 11/1983 | Ottaviano | 156/145 |
| 4,415,398 | A | | 11/1983 | Ottaviano | 156/470 |
| 4,564,407 | A | | 1/1986 | Tsuruta | 156/147 |
| 4,619,635 | A | | 10/1986 | Ottaviano | 493/36 |
| 4,644,733 | A | | 2/1987 | Dolinar | 53/472 |
| 4,714,506 | A | | 12/1987 | Yamashiro et al. | 156/80 |
| 4,847,126 | A | | 7/1989 | Yamashiro et al. | 428/35.2 |
| 4,850,912 | A | | 7/1989 | Koyanagi | 441/40 |
| 4,894,264 | A | | 1/1990 | Akao et al. | 428/34.2 |
| 4,894,265 | A | | 1/1990 | Chang et al. | 428/34.6 |
| 5,070,675 | A | | 12/1991 | Chuan-Shiang | 53/79 |
| 5,203,761 | A | | 4/1993 | Reichental et al. | 493/346 |
| 5,216,868 | A | | 6/1993 | Cooper et al. | 53/79 |
| 5,257,492 | A | | 11/1993 | Watts | 53/430 |
| 5,312,132 | A | | 5/1994 | Pillet | 280/743 R |
| 5,340,632 | A | | 8/1994 | Chappuis | 428/71 |
| 5,427,830 | A | | 6/1995 | Pharo | 428/35.2 |
| 5,454,642 | A | | 10/1995 | De Luca | 383/3 |
| 5,500,067 | A | | 3/1996 | Jenkner | 156/146 |
| 5,535,888 | A | | 7/1996 | De Luca | 206/522 |
| 5,552,003 | A | | 9/1996 | Hoover et al. | 156/147 |
| 5,581,983 | A | | 12/1996 | Murakami | 53/512 |
| 5,588,533 | A | | 12/1996 | Farison et al. | 206/522 |
| 5,620,096 | A | | 4/1997 | Pozzo | 206/450 |
| 5,660,662 | A | | 8/1997 | Testone | 156/145 |
| 5,673,541 | A | | 10/1997 | Arzuman et al. | 53/459 |
| 5,693,163 | A | | 12/1997 | Hoover et al. | 156/147 |
| 5,755,082 | A | | 5/1998 | Takahashi et al. | 53/511 |
| 5,755,328 | A | | 5/1998 | DeLuca | 206/522 |
| 5,824,392 | A | | 10/1998 | Gotoh et al. | 428/178 |
| 5,862,914 | A | | 1/1999 | Farison et al. | 206/522 |
| 5,873,215 | A | | 2/1999 | Aquarius et al. | 53/403 |
| 5,937,614 | A | * | 8/1999 | Watkins et al. | 53/79 |
| 5,938,877 | A | | 8/1999 | Schram | 156/145 |
| 5,942,076 | A | | 8/1999 | Salerno et al. | 156/359 |
| RE36,501 | E | | 1/2000 | Hoover et al. | 156/147 |
| 6,015,047 | A | | 1/2000 | Greenland | 206/522 |
| RE36,759 | E | | 7/2000 | Hoover et al. | 156/147 |
| 6,116,000 | A | | 9/2000 | Perkins et al. | 53/472 |
| 6,170,227 | B1 | | 1/2001 | Kovacs et al. | 53/64 |
| 6,195,966 | B1 | * | 3/2001 | Shomron et al. | 53/451 |
| 6,199,349 | B1 | | 3/2001 | Lerner | 53/472 |
| 6,213,167 | B1 | | 4/2001 | Greenland | 141/10 |
| 6,253,806 | B1 | | 7/2001 | Sperry et al. | 141/314 |
| 6,253,919 | B1 | | 7/2001 | Sperry et al. | 206/522 |
| 6,341,473 | B1 | * | 1/2002 | Kovacs et al. | 53/450 |
| 6,410,119 | B1 | | 6/2002 | De Luca et al. | 428/166 |
| 6,421,985 | B1 | | 7/2002 | Simmons, Jr. et al. | 53/472 |
| 6,423,166 | B1 | | 7/2002 | Simhaee | 156/156 |
| 6,453,644 | B1 | * | 9/2002 | Baker | 53/403 |
| 6,460,313 | B1 | | 10/2002 | Cooper | 53/79 |
| 6,519,916 | B1 | | 2/2003 | Brown | 54/403 |
| 6,536,183 | B1 | | 3/2003 | Brown | 53/79 |
| 6,550,229 | B2 | | 4/2003 | Sperry et al. | 53/568 |
| 6,565,946 | B2 | | 5/2003 | Perkins et al. | 428/166 |
| 6,569,283 | B1 | | 5/2003 | Sperry et al. | 156/583.2 |
| 6,582,800 | B2 | | 6/2003 | Fuss et al. | 428/178 |
| D480,971 | S | | 10/2003 | DeLuca et al. | D9/456 |
| 2001/0000719 | A1 | | 5/2001 | Lerner et al. | 410/119 |
| 2001/0001921 | A1 | | 5/2001 | Sperry et al. | 53/403 |
| 2001/0013215 | A1 | | 8/2001 | Fuss et al. | 53/403 |
| 2001/0049921 | A1 | | 12/2001 | Sperry et al. | 53/403 |
| 2002/0092279 | A1 | | 7/2002 | Sperry et al. | 53/568 |
| 2002/0108351 | A1 | | 8/2002 | Sperry et al. | 53/403 |
| 2002/0108352 | A1 | | 8/2002 | Sperry et al. | 53/403 |
| 2002/0108697 | A1 | | 8/2002 | Perkins et al. | 156/145 |
| 2002/0112808 | A1 | | 8/2002 | Perkins et al. | 156/145 |
| 2002/0129583 | A1 | | 9/2002 | Simmons, Jr. et al. | 53/472 |
| 2002/0150730 | A1 | | 10/2002 | DeLuca et al. | 428/178 |
| 2002/0162301 | A1 | | 11/2002 | Davey | 53/403 |
| 2002/0189752 | A1 | | 12/2002 | Wersch | 156/291 |
| 2003/0041566 | A1 | | 3/2003 | Hilbert, Sr. et al. | 53/450 |
| 2003/0079439 | A1 | | 5/2003 | Brown | 53/79 |
| 2003/0089082 | A1 | | 5/2003 | Fuss et al. | 53/403 |
| 2003/0118778 | A1 | | 6/2003 | Perkins et al. | 428/166 |

FOREIGN PATENT DOCUMENTS

| | | | | |
|---|---|---|---|---|
| EP | 0240827 | B1 | 11/1989 | B31B/39/00 |
| EP | 0399965 | | 11/1990 | |
| EP | 0401414 | A1 | 12/1990 | B65B/9/13 |
| EP | 0256346 | B1 | 10/1991 | B42F/5/04 |
| EP | 0345235 | B1 | 10/1991 | B65D/81/14 |
| EP | 0269145 | B1 | 3/1992 | B65B/9/13 |
| EP | 0512187 | B1 | 11/1992 | B29C/49/00 |
| EP | 0329496 | B1 | 1/1993 | B65D/81/06 |
| EP | 0523382 | A2 | 1/1993 | B31F/1/07 |
| EP | 0513235 | B1 | 10/1993 | B65B/9/13 |
| EP | 0523382 | B1 | 9/1996 | B31F/1/07 |
| EP | 0787574 | A2 | 8/1997 | B29D/22/00 |
| EP | 0796802 | A2 | 9/1997 | B65D/65/40 |
| EP | 0816228 | A2 | 1/1998 | B65B/9/15 |
| EP | 0836926 | | 4/1998 | |
| EP | 0816228 | A3 | 5/1998 | B65B/9/15 |
| EP | 0805769 | B1 | 8/1998 | B65D/81/05 |
| EP | 0689929 | B1 | 9/1998 | B29C/65/02 |
| EP | 0718195 | B1 | 2/1999 | B65B/51/30 |
| EP | 0810958 | B1 | 12/1999 | B65D/81/05 |
| EP | 0978455 | A2 | 2/2000 | B65B/55/20 |
| EP | 1013573 | A1 | 6/2000 | B65G/51/02 |
| EP | 0978455 | A3 | 7/2000 | B65B/55/20 |
| EP | 1022124 | A1 | 7/2000 | B31D/5/00 |
| EP | 1022234 | A1 | 7/2000 | B65D/81/05 |
| EP | 0701954 | B1 | 10/2000 | B65D/81/03 |
| EP | 1044793 | A1 | 10/2000 | B31D/5/00 |
| EP | 0935521 | B1 | 12/2000 | B29C/44/18 |
| EP | 1138596 | A1 | 10/2001 | B65B/9/13 |
| EP | 1161932 | A2 | 12/2001 | A61J/1/10 |
| NL | 1011096 | | 1/1999 | B29C/69/00 |
| WO | WO 89/06557 | A1 | 7/1989 | A63B/39/00 |
| WO | 94/07678 | | 4/1994 | |
| WO | WO 96/22926 | A1 | 8/1996 | B65D/81/05 |
| WO | WO 97/20756 | A1 | 6/1997 | B65D/81/05 |
| WO | WO 98/23502 | A1 | 6/1998 | B65D/81/05 |
| WO | 98/26137 | | 6/1998 | |
| WO | 98/40276 | | 9/1998 | |
| WO | WO 99/02409 | A1 | 1/1999 | B65B/59/00 |
| WO | WO 99/46103 | A1 | 9/1999 | B29C/44/04 |
| WO | WO 99/46182 | A2 | 9/1999 | B65D/81/00 |
| WO | WO 00/27619 | A1 | 5/2000 | B31D/5/00 |
| WO | WO 00/43198 | A1 | 7/2000 | B32B/3/02 |
| WO | WO 00/53501 | A1 | 9/2000 | B65B/31/00 |
| WO | WO 01/53153 | A1 | 7/2001 | B65B/31/06 |
| WO | WO 01/85434 | A2 | 11/2001 | B29C/49/00 |
| WO | WO 02/14156 | A1 | 2/2002 | B65B/31/00 |
| WO | WO 02/26589 | A1 | 4/2002 | B65D/81/05 |
| WO | WO 02/64359 | A2 | 8/2002 | B31D/5/00 |

* cited by examiner

METHOD AND MACHINE FOR THE MANUFACTURE OF AIR PILLOWS

DESCRIPTION OF THE INVENTION

This invention is concerned with improvements relating to the manufacture of air pillows, in particular air pillows of thin-walled plastic sheet which may be used as an infill or cushioning in the packaging and transportation of fragile articles.

Conventionally utilised in the manufacture of air-filled pillows is thin walled polythene tubing, which may be unwound from a continuous supply thereof flat-wound on a reel, and it is in this context that the invention will hereinafter be described, although it is to be appreciated that the invention is not limited to the use of polythene as such, and that other appropriate materials may be utilised as desired.

Numerous suggestions have been made for the manufacture of air-filled pillows of this kind (hereinafter referred to as being of the kind specified), but in general difficulty has been encountered in the injection of air into a section of tubing, and subsequently sealing the tube to form individual pillows.

According to this invention there is provided a machine for the manufacture of air-filled pillows comprising:

a) a separator member which may be inserted into a length of plastic tubing drawn from a supply thereof;

b) retaining means for retaining the separator member in a desired position in the machine, within the tubing, in such a manner as to allow the tubing to be pulled across the separator member;

c) an injector means co-operable with the separator member to inject air through one wall of the tubing into the interior of the tubing; and d) sealing means to seal the tube across the location of the injection point.

By the use of a separator member which is captive within the polythene tubing to separate the walls of the tubing, injection of air through an aperture in the tubing may more reliably be accomplished without the risk of puncturing the tubing at two locations. Specifically by the use of the separator member, such injection may be accomplished without the need for air pressure within the machine to hold the walls of the tube apart, whilst injection is taking place.

Preferably the separator member additionally provides a supporting surface to support one wall of the tubing whilst an injection nozzle is inserted through the wall, during the injection of air into the space between the walls of the tubing.

Preferably the machine comprises drive means to draw tubing material from the supply thereof, conveniently by intermittent operation.

Preferably the machine comprises control means for the injector means, the drive means and the sealing means, which is operative to cause the injector means to operate whilst operation of the drive means is momentarily terminated, and subsequent to operation of the injector means to cause the drive means to advance the material a short distance to the sealing means.

Preferably the machine comprises a support member located adjacent to the separator member and between which one wall of the tube is located as the tube is advanced through the machine, and conveniently the support member is provided with an aperture in alignment with an aperture provided in the separator member, through which a nozzle of the injector means passes in the injection of air into the tube.

The retaining means for the separator member may be provided by a housing in which part of the separator member is located in a manner such as to prevent any substantial movement of the separator member from a desired position within the machine, particularly as tends to occur as the tubing is drawn over the separator member in the operation of the machine, but such as to allow the polythene tubing to be drawn through the housing over the separator member as the tubing is advanced through the machine.

Conveniently the housing is split, comprising portions which may be secured together so as to extend partially at least around the separator member whilst within the tube.

Alternatively the retaining means may be provided by one or more drive rollers of the machine with which the separator member is drawn into engagement as the drive means operates to draw tubing through the machine.

Preferably the sealing means is operative to seal the tube along two lines extending transversely of the tube on opposite sides of the injection point, and to provide a tear-line extending between the two seal lines.

According to this invention there is also provided a machine for the manufacture for air-filled pillows from a continuous supply of plastic tube flat-wound onto a reel, the machine comprising a) a drive assembly to advance the plastic tube intermittently through the machine;

b) injection means operative intermittently to inject air into the space between upper and lower walls of the tube; and c) sealing means operative downstream of the injection means intermittently to seal the upper and lower walls of the tube; characterised in that a separator member is provided which is located within the tube between the upper and lower walls thereof upstream of the injection means, said separator member being maintained in an operative position within the machine during advancement of the tube through the machine by engagement with the drive assembly.

Conveniently said engagement is indirect, in the sense that the separator member engages the drive assembly through the thickness of the polythene tube.

Conveniently the drive assembly engages the tube to draw the tube over the separator member whilst preventing substantial movement of the separator member from a desired position relative to the machine.

Preferably the drive assembly comprises upper and lower rollers operative to engage the upper and lower walls of the tube.

Advantageously the separator member is adapted to co-operate with the injector means, and comprises an aperture through which a nozzle of the injector means passes in the injection of air into the space between the upper and lower walls of the tube.

According to this invention there is also provided a method of making an air-filled pillow involving the use of continuous thin-walled plastic tube, in which the walls of the tube are retained apart by a separator member which is retained in position whilst the plastic film is drawn from a supply thereof, the separator member retaining the walls of the tube separated during the injection of air into the tube.

There will now be given a detailed description, to be read with reference to the accompanying drawings, of two machines for the manufacture of air-filled pillows, which are preferred embodiments of the invention, having been selected for the purposes of illustrating the invention by way of example, the method of operation of the machines in the making of an air-filled pillow also being illustrative of the invention in certain of its aspects.

Figure 1:
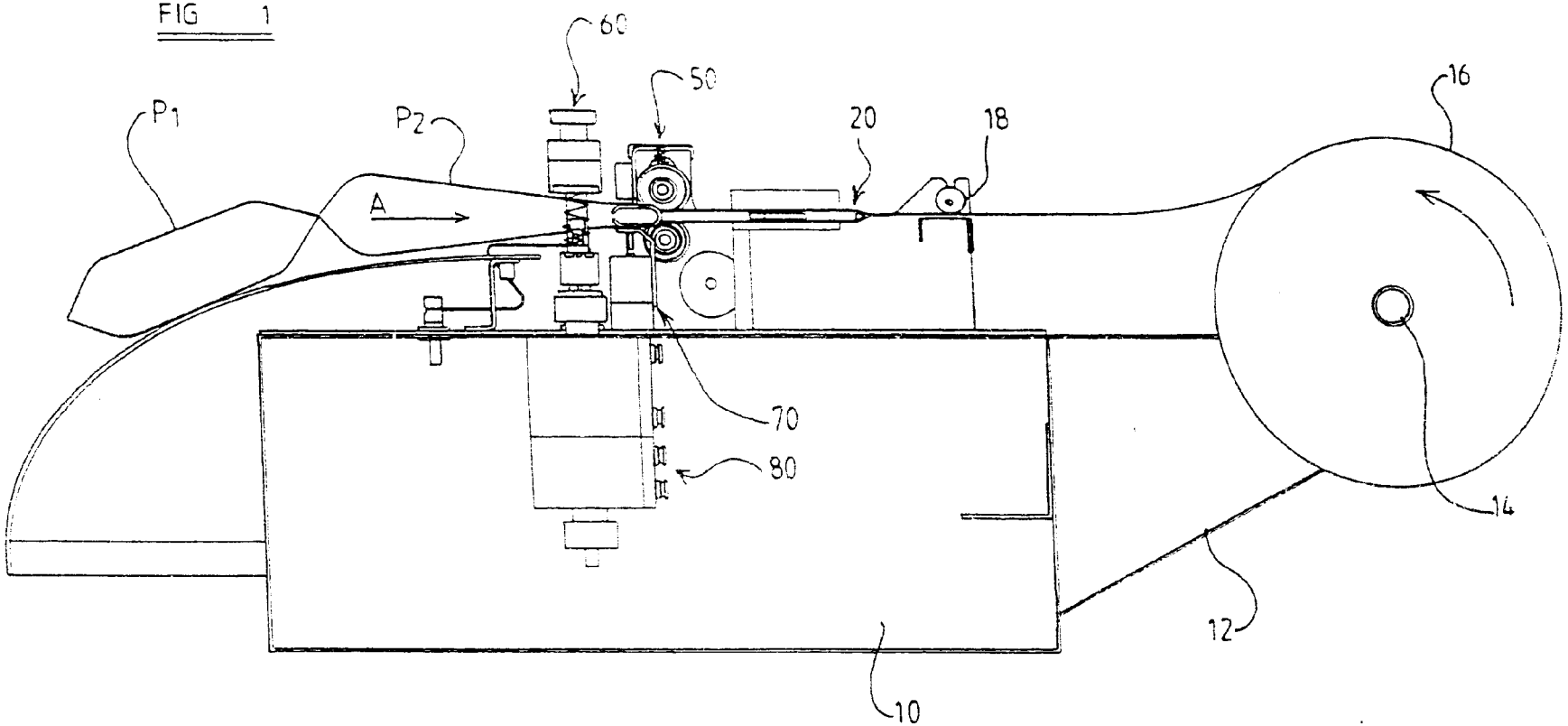
FIG. 1 is a side elevation of the machine which is the first embodiment of the invention.
Figure 2:
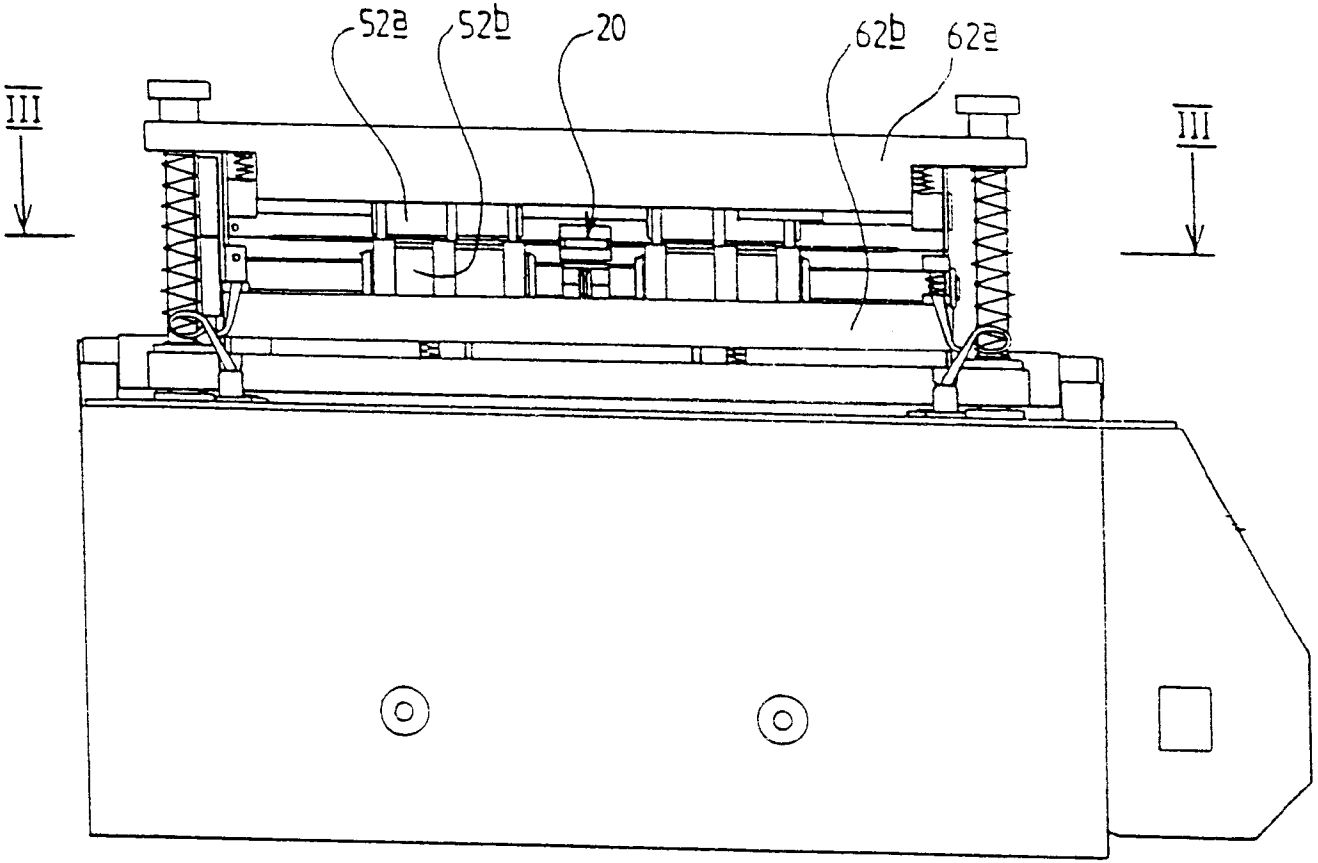
FIG. 2 is a front view of the machine, taken in the direction of the arrow A of FIG. 1.

The machine which is the first embodiment of this invention is for the manufacture of air-filled pillows which may be used as infill and cushioning in the packaging and transportation of fragile articles. The machine comprises a housing 10 from which side arms 12 extend rearwardly to a mounting 14 upon which a roll 16 of thin-walled plastic tube is mounted, and from which tube may be drawn in the form of a flat sheet, towards a guide roller 18 of the machine.

Figure 5:
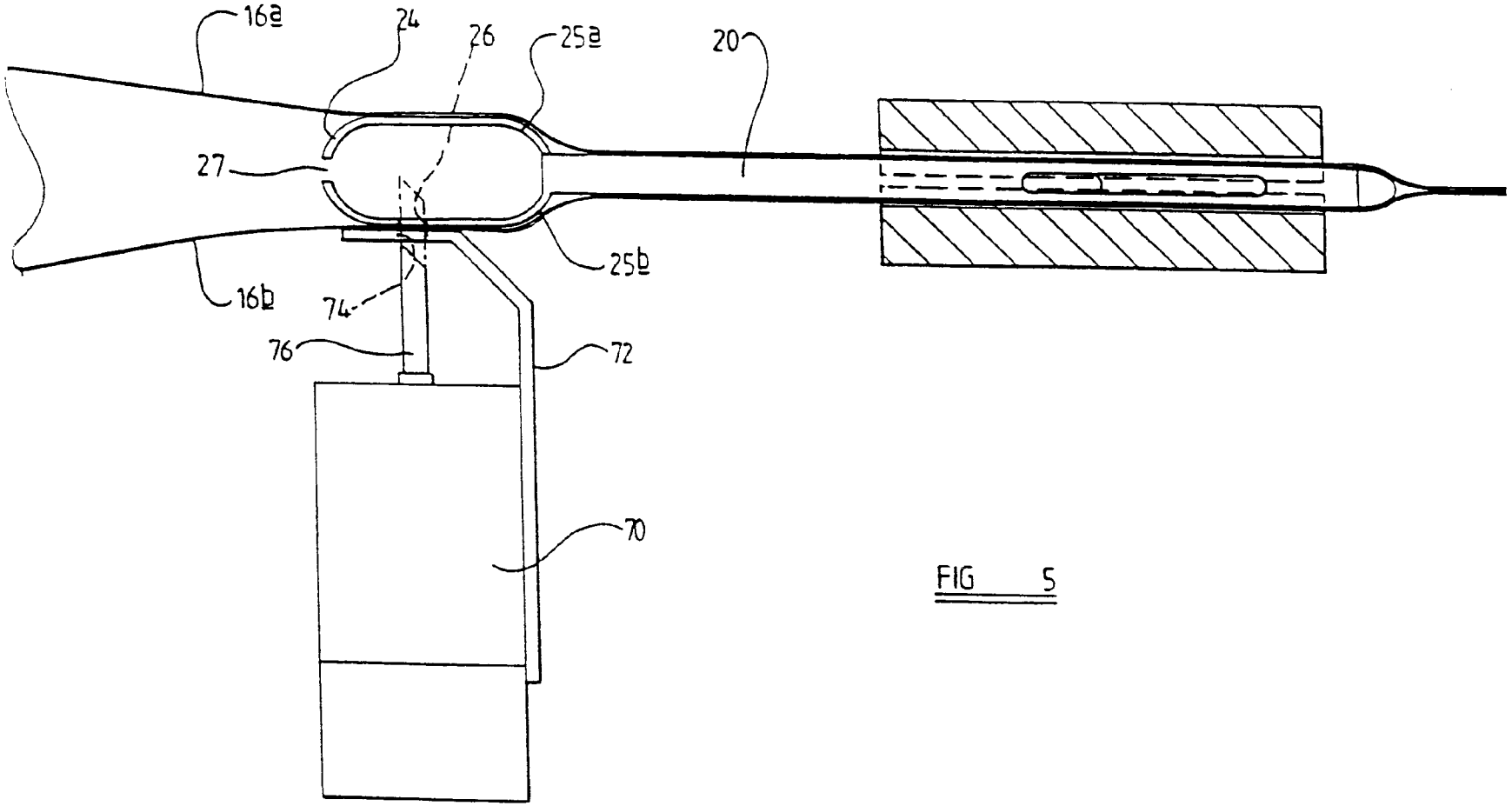
FIG. 5 is an enlarged view showing a separator member of the first embodiment.

Mounted a short distance in front of the guide roller 18 is a separator member 20, comprising a generally elongate, tubular body portion 21 from which side arms 22 extend laterally, said body portion extending in a tail housing 24 (see FIG. 5).

The tail housing 24 comprises upper and lower arms 25*a,* 25*b,* spaced apart for the purposes hereinafter described, as shown at 27 in FIG. 5.

The separator member is held captive in a separator retaining housing 30, comprising a lower portion 32 and an upper portion 34 connected to the lower portion by a hinge mechanism (not shown).

Figure 3:
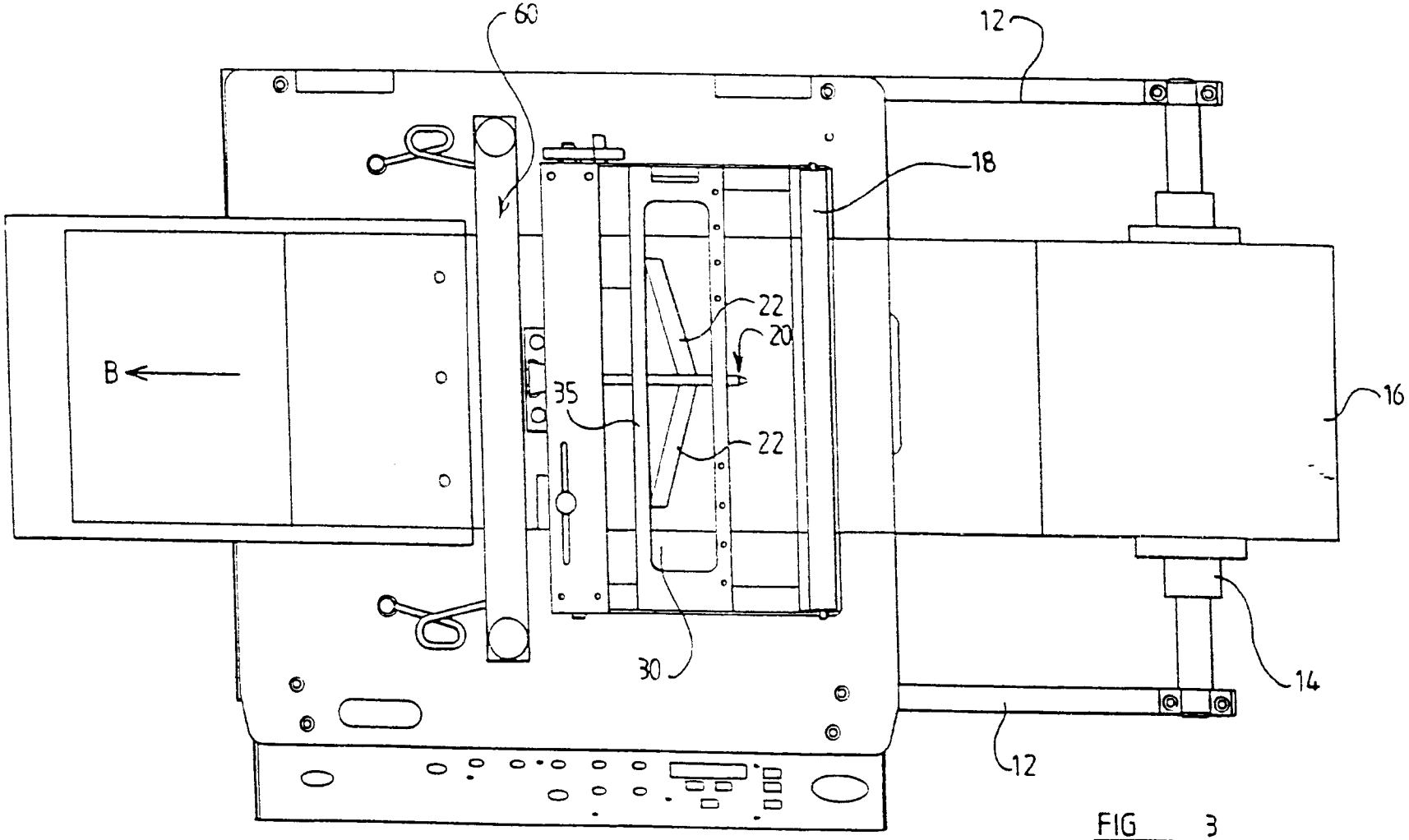
FIG. 3 is a sectional view of the machine, taken on the line III—III of FIG. 2.

The lower portion is provided with a peripheral wall 33, and in the transverse portions of these walls generally along the centreline of the machine shallow recesses 36*a,* 38*a* are provided. The upper portion 34 is similarly provided with a peripheral wall 35 (see FIG. 3), in an underside of which, at positions corresponding to the recesses 36*a* and 38*a,* corresponding shallow recesses 36*b* and 38*b* are provided.

Figure 6:
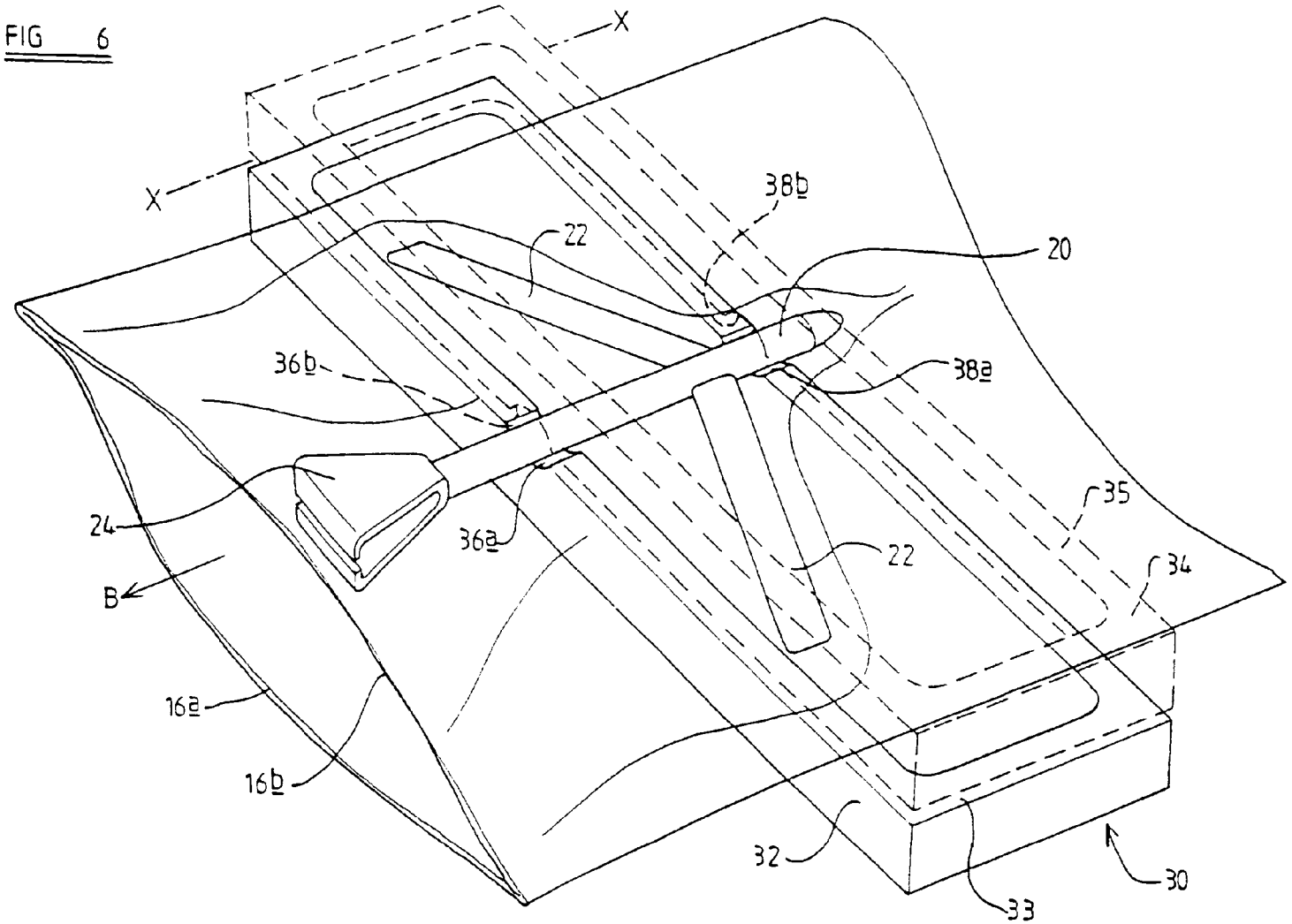
FIG. 6 is a perspective view showing the separator member retained in position within a separator housing of the machine.

The separator retaining member is shown in FIG. 6 in a closed position. However, by pivotal movement of the upper portion about an axis X—X, access to the interior of the separator retaining member may be gained.

In use, the separator member 20 is lifted from the lower portion 32 of the retaining housing 30, and a length of polythene tube is drawn from the roll 16 over the guide roller 18, and laid over the lower portion 32, and as shown in FIG. 6. The separator member is then manually inserted into the end portion of the tube, between the upper and lower walls 16*a,* 16*b,* the elongate tubular body of the separator member being placed on the shallow recesses 36*a,* 38*a,* of the housing with the side arms 22 being located within the peripheral wall 33.

When the upper portion 34 of the separator retailing housing 30 is in its closed position, there is a small degree of separation between the peripheral walls 33 and 35 (also seen in FIG. 5), and whilst the separator member 20 is capable of limited axial movement, determined by engagement of the side arms 22 with the peripheral walls, the separator member is generally retained in a specific position within the machine, by the retaining housing 30.

In the setting of the machine, the leading end portion of polythene tubing is drawn from the supply roll 16 beneath the guide roller 18, and with the housing 30 open, across the lower portion 32 of the retaining housing, and the separator member is inserted manually into the end portion of the polythene tube. The upper portion 34 of the retaining housing is moved to its closed position, in which position the separator member is retained in position relative to the machine, but in which the polythene tubing may be drawn continuously in the direction of the arrow B over the separator member.

Figure 4:
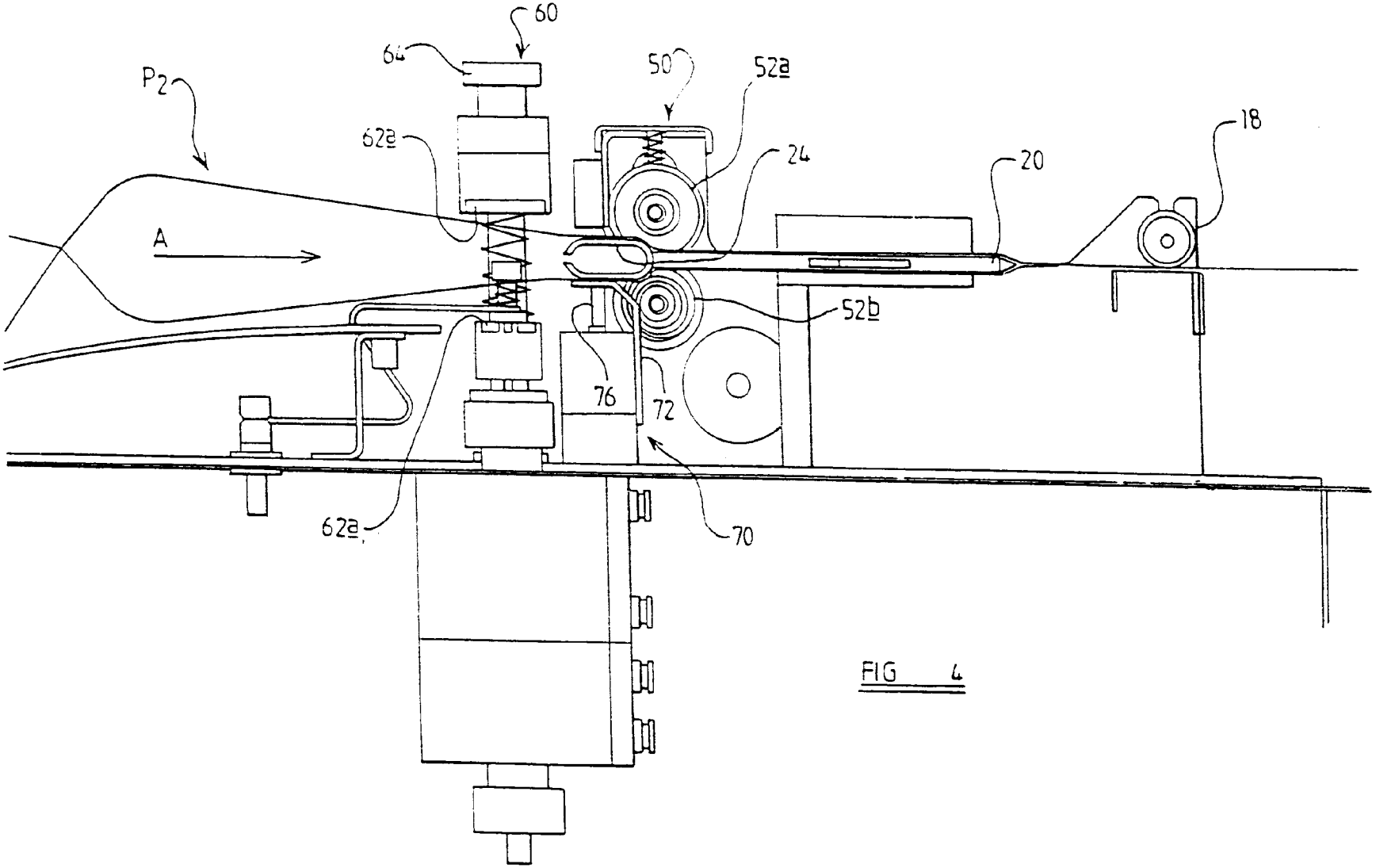
FIG. 4 is an enlarged view of part of FIG. 1.

In setting up the machine, the leading end portion of the tubing is drawn through drive mechanism 50, and through clamping mechanism 60, shown in FIG. 4.

The machine comprises an injector manifold 70 (see FIG. 5) mounted downstream of the drive mechanism 50, comprising a support bracket 72 located beneath the tail housing 24, said support bracket comprising an aperture 74 located directly adjacent to an aperture 26 provided at a central portion of the lowermost part of the tail housing 24, (see FIG. 5).

The injection mechanism also comprises an injection needle 76, and drive means (not shown) to move the needle in a vertical direction from a lowermost, inoperative position, shown in full lines in FIG. 5, to an operative position shown in dotted lines in FIG. 5 in which the needle projects through the aperture 74 in the support bracket 72, and through the aperture 26 in the lowermost portion of the tail housing 24, passing through the lower wall of the plastic tubing drawn over the separator member 20, the separator member 20 providing a support surface against which the lower wall of the tubing is pressed as the needle passes through the lower wall.

In practice although the separator member 20 is capable of limited movement within the retaining housing 30, such movement is insufficient to prevent the injector needle aligning correctly with the aperture 26.

Control mechanism of the machine (not shown in detail but indicated by the number 80) is operative, when the nozzle 76 is moved to its uppermost position, to inject a measured, adjustable volume of air through the needle 76, into the central region of the tail housing 24, ie. between the upper and lower walls 16*a,* 16*b* of the polythene tubing 16, (see FIG. 5).

The clamping mechanism 60 is mounted a short distance downstrean of the injector mechanism 70, comprising upper and lower heated clamping bars 62*a,* 62*b* (see FIG. 4) and power means 64 operative under the control of the control mechanism to bring the clamping bars together to provide a transverse seal across the polythene tubing as it is drawn through the machine.

The drive mechanism 50 comprises upper and lower drive rollers 52*a,* 52*b,* operative to engage the plastic tubing therebetween, and to draw it in the feed direction B (FIG. 3) under the control of the control mechanism 80.

A cycle of operation of the machine will now be described, commencing at the position shown in FIG. 4, in which a quantity of air has just been injected through the injector needle 76 into a section of polythene tubing P2.

On retraction of the needle 76, the drive mechanism operates to advance the polythene tubing a short distance equal to the distance between the needle and the clamping bars, so that the aperture provided in the lower wall 16*b* is located directly above the lower clamping bar 62*a*. The operating mechanism causes the clamping bars to move together, against the action of internal springs, to cause the clamping mechanism to provide two lines of seal between the upper and lower sheets extending on opposite sides of the aperture, simultaneously providing a row of perforations between the seal lines, to complete manufacture of the air pillow P2. On completion of a brief dwell time the power means 64 is relaxed, allowing the clamping bars to separate, and a trigger signal applied to the control mechanism causes the drive mechanism to advance the polythene tube over the separator member. Preferably the leading faces at least of the separator member are coated with PTFE or the like, to assist in the smooth gliding of the polythene over the separator member.

On completion of a desired distance of advance, operation of the drive mechanism is momentarily terminated, and the injector needle 76 is moved from its retracted to its advanced position, again puncturing the lower wall 16*b* of the polythene tube, to inject a measured quantity of air in the formation of a further pillow, as is shown in FIG. 4. Again, the needle 76 is retracted, and the polythene tubing is advanced to bring the aperture into position between the two sealing bars.

It will be appreciated that by the use of the invention above described, separation of the upper and lower walls 16*a,* 16*b* of the polythene tube is produced by the tail housing of the separator member, and is not dependant upon air injected into the tube.

Naturally, some flow of air rearwardly of the tail housing will take place, which may indeed assist the smooth flow of the polythene tube across the separator member 20, but this is incidental to the capability of the machine to provide a measured quantity of air injected between the walls 16*a* and 16*b*.

The control mechanism may comprise, in accordance with conventional practice, adjustment capability for varying the time of operation of the drive mechanism subsequent to the sealing operation, determining the length of the air pillow formed during successive operations of the machine; and the volume of air delivered by the injector needle 76, and the pressure to which the tube is filled.

By the invention above described air filled pillows may be obtained quickly and reliably, and with relatively few moving parts.

The second embodiment of the machine, shown in FIGS. 7 to 12, is similar in general to the first embodiment above described, and will be described hereinafter primarily only insofar as it differs in construction and operation from the first embodiment, and similar numerals, provided with the prefix number 1, have been utilised to identify similar parts.

Figure 7:
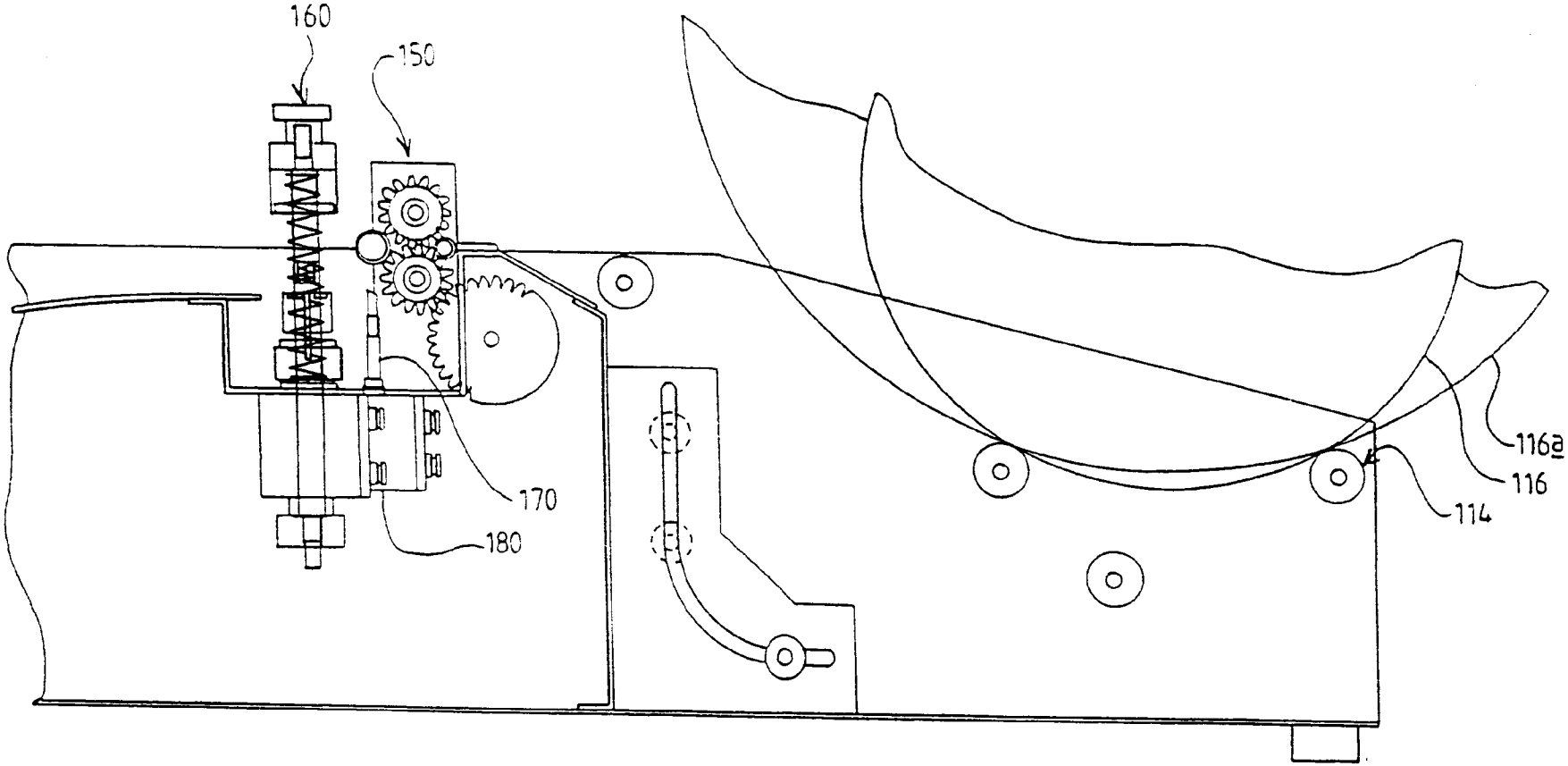
FIG. 7 is a side elevation of the machine which is the second embodiment of the invention.
Figure 9:
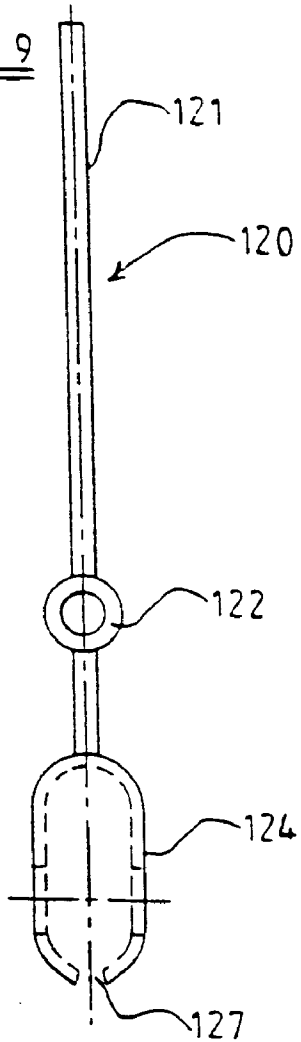
FIGS. 8 and 9 are respectively plan and side elevational views of the separator member of the second embodiment.
Figure 8:
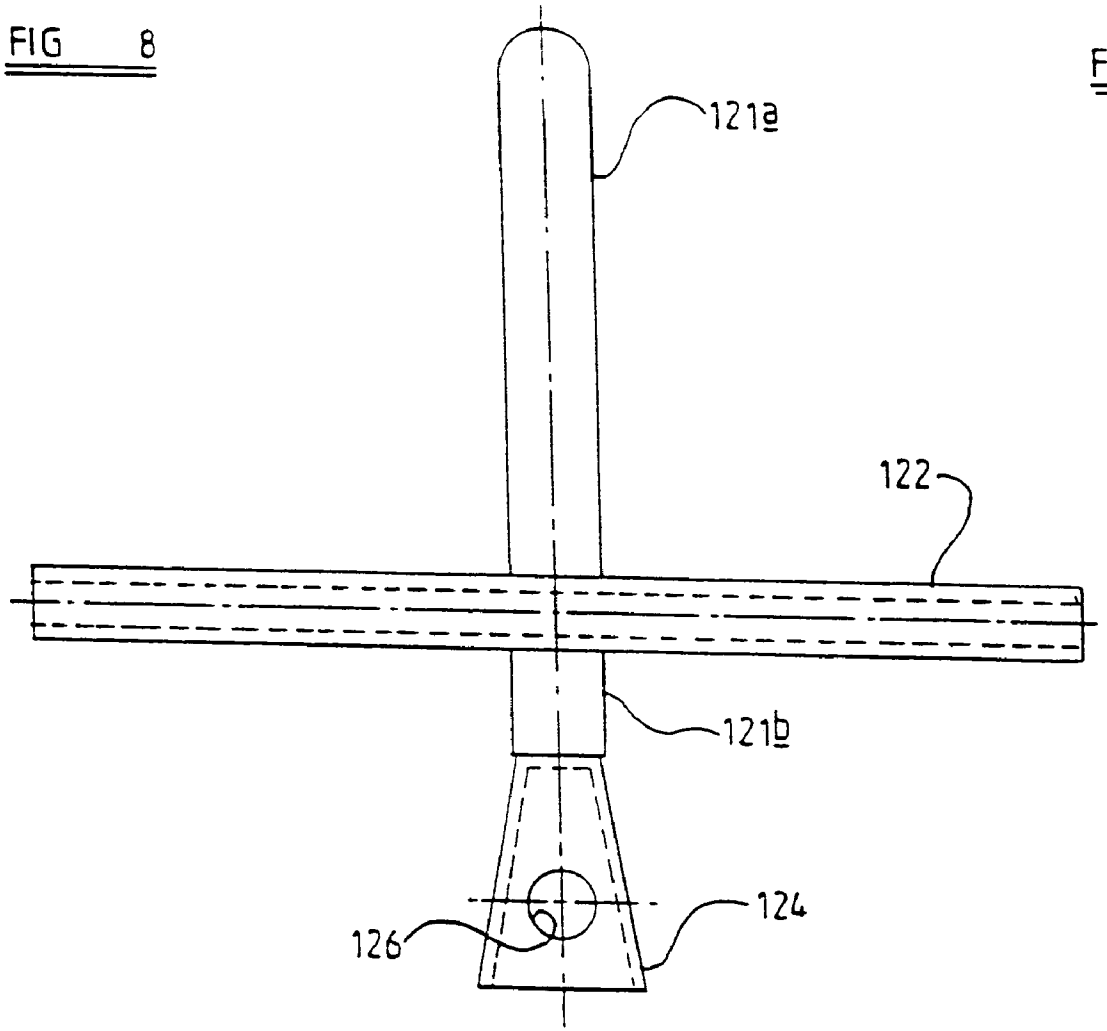

In the second embodiment support rollers 114 are utilised to support rolls 116 or 116*a* of a variety of sizes, from which thin-walled plastic tube may be drawn into the machine, (see FIG. 7). Conveniently take-up mechanism (not shown) is utilised to provide a constant tension on the tube, and to accommodate for roll over-run.

In the second embodiment the support member 120 comprises a transversely extending tubular body portion 22, from which a longitudinal body portion 121*a* extends in the forward direction, and a body portion 121*b* extends in the rearward direction to a tail housing 124, the body portion 122 providing a continuous exterior tubular surface which has a diameter greater than the thickness of the body portions 121*a* or 121*b* (see FIGS. 5, 7, 8 and 9).

The drive means of the modified version comprises upper and lower drive rollers 152*a,* 152*b* which are operative in the performance of the machine to draw plastic tubing intermittently from the supply, and simultaneously to retain the separator member in an operative position within the machine. Thus in the modified version the drive rollers 152*a* and 152*b* also perform the function of the retaining housing of the first embodiment.

Figure 12:
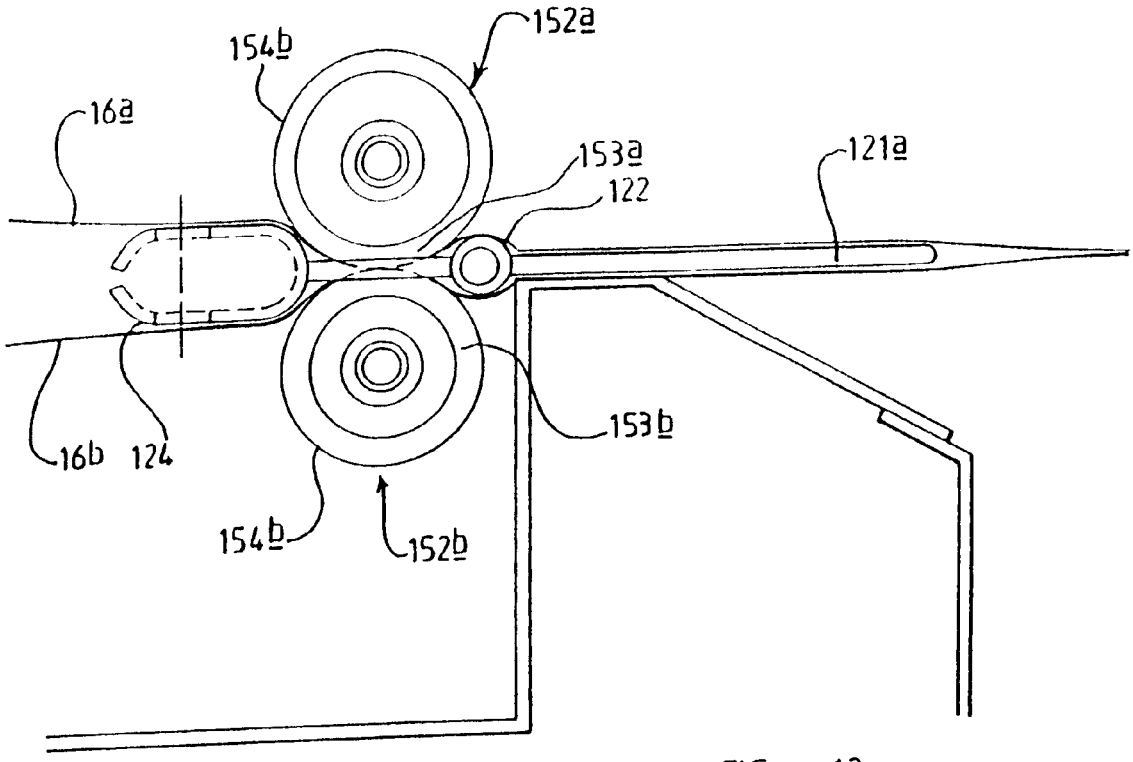
FIG. 12 is an enlarged side elevation showing the action of the separator member in separating the top and bottom sheet of the plastic tube utilised in the performance of this invention.

In particular, the rear body portion 121*a* is located in recessed or channel sections 153*a,* 153*b* of the drive rollers 152*a,* 152*b*. Sufficient clearance is provided between the surfaces of the drive rollers and the surfaces of the separator member to permit polythene tube to be drawn over the separator member as shown in FIG. 12, to cause separation of the upper and lower walls 16*a,* 16*b* of the tube so as to allow movement of an injector needle through an aperture 126 in the tail housing and through the bottom wall 16*b,* for the injection of air into the space between the top and bottom walls, (see FIGS. 12 and 13).

Figure 10:
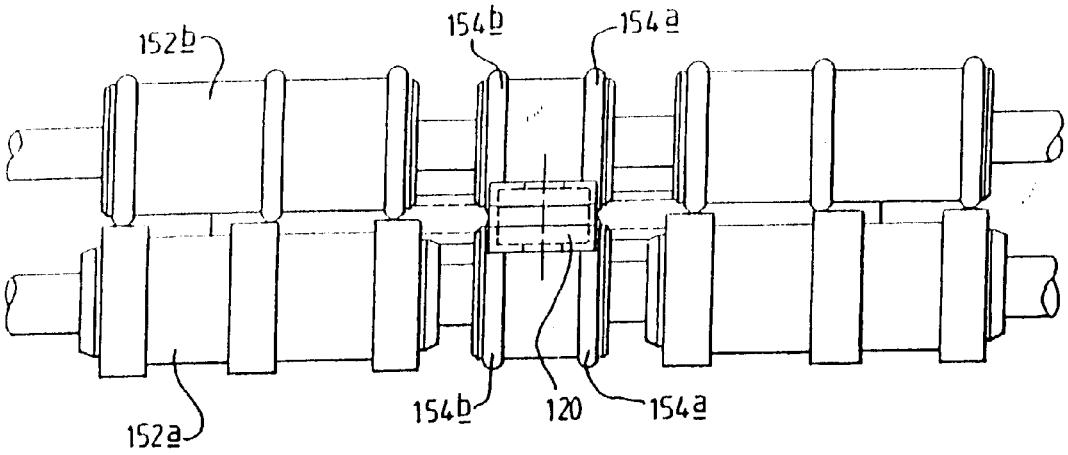
FIGS. 10 and 11 are respectively front elevation and plan views of the second embodiment, showing co-operation between the separator member and the drive means of the machine.
Figure 11:
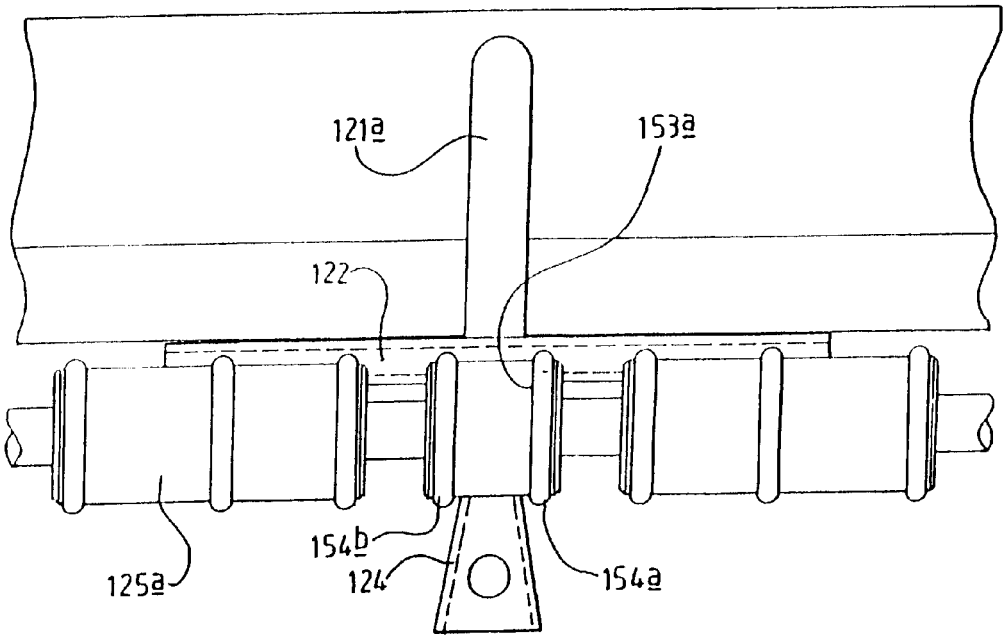

As will be appreciated, whilst engagement of the separator member with the drive rollers prevents any significant degree of movement of the separator member in the longitudinal direction, engagement of the rear housing 124 with the circumferential flanges 154*a,* 154*b* bounding the recesses 153*a,* 153*b* prevents any significant degree of lateral movement of the separator member, (see FIGS. 10 and 11).

Conveniently in the modified version of the preferred embodiment the drive rollers 152*a,* 152*b* are mounted for separative movement in the setting up of the machine. Thus, tube is initially drawn from the supply roll 116, and the separator member 120 inserted manually into the leading open end of the polythene tube. The separator member is located as shown in the drawings between the drive rollers 152*a,* 152*b,* which may then be closed around the separator member into their operative positions, to draw tube from the supply around the separator member. The leading end portion of the tube is then manually drawn through the machine, through the clamping mechanism.

It will be appreciated that in the use of the machine, engagement of the separator member with the drive rollers is indirect, in that sheets of polythene are located between the separator member and the surfaces of the drive rollers. Thus, conveniently the drive rollers are provided with a high friction coating, such as of rubber or the like, to assist in drawing the polythene tubing around the separator member.

In the present specification "comprise" means "includes or consists of" and "comprising" means "including or consisting of".

The features disclosed in the foregoing description, or the following claims, or the accompanying drawings, expressed in their specific forms or in terms of a means for performing the disclosed function, or a method or process for attaining the disclosed result, as appropriate, may, separately, or in any combination of such features, be utilised for realising the invention in diverse forms thereof.

What is claimed is:

1. A machine for the manufacture of air-filled pillows from a supply of plastic tube flat-wound on a reel, the machine comprising:

a drive assembly to advance the plastic tube through the machine;

a separator member which may be inserted into the plastic tube drawn from the supply and which is operative to retain opposed walls of the tube separated;

location means comprising a pair of rollers between which the tube passes, the rollers being operative to restrain movement of the separator member in the direction of movement of the tube through the machine;

injector means to inject air into an interior of the tube; and sealing means to seal the tube transversely thereof;

characterized in that the separator member and injector means are co-operable so as to allow the air to be injected into the tube interior.

2. The machine of claim 1 wherein the drive means is operative intermittently.

3. The machine of claim 1 wherein the injector means is co-operable with the separator member to pass through one wall of the tube and to inject air into the tube.

4. The machine of claim 1 wherein the separator member is provided with an aperture through which a nozzle of the injector means passes in the injection of air into the tube.

5. The machine of claim 1 wherein the sealing means is operative to seal the tube across a point at which the injector means passes air into the tube.

6. The machine of claim 1 further comprising a support member located adjacent to the separator member and wherein one wall of the tube is located between the support member and the separator member as the tube is advanced through the machine.

7. The machine of claim 6 wherein the support member is provided with an aperture in alignment with the aperture provided in the separator member, through which a nozzle of the injector passes during injection of air into the tube.

8. The machine of claim 1 wherein the rollers rotate during operation of the machine.

9. The machine of claim 8 wherein the rollers constitute the drive assembly by which the tube is drawn from the supply thereof.

* * * * *